US006394576B1

(12) United States Patent
Yang

(10) Patent No.: US 6,394,576 B1
(45) Date of Patent: May 28, 2002

(54) PRINTING APPARATUS AND METHOD

(75) Inventor: Po-Ching Yang, Tainan (TW)

(73) Assignee: Acer Communications and Multimedia Inc., Taipei (TW)

( * ) Notice: Subject to any disclaimer, the term of this patent is extended or adjusted under 35 U.S.C. 154(b) by 0 days.

(21) Appl. No.: 09/682,338

(22) Filed: Aug. 22, 2001

(30) Foreign Application Priority Data

Dec. 22, 2000 (TW) ..... 089127640

(51) Int. Cl.[7] ..... B41J 2/145; B41J 2/15
(52) U.S. Cl. ..... 347/40
(58) Field of Search ..... 347/19, 40, 43

(56) References Cited

U.S. PATENT DOCUMENTS 5,485,180 A * 1/1996 Askeland et al. ..... 347/15
6,179,407 B1 * 1/2001 Bockman ..... 347/40
6,238,037 B1 * 5/2001 Overall et al. ..... 347/41

* cited by examiner

*Primary Examiner*—Thinh Nguyen
(74) *Attorney, Agent, or Firm*—Winston Hsu

(57) ABSTRACT

A printing apparatus has an ink jet print head that performs printing passes on a jetting position of the printing area. The ink jet print head has nozzles, each nozzle prints ink spots on a jetting position of the printing area. The ink jet print head performs printing according to a predetermined printing method. The predetermined printing method distributes all ink spots to be printed on the jetting position of the printing area to the printing passes to make the number of ink spots printed on the jetting position in each print pass approximately equal.

18 Claims, 10 Drawing Sheets

PRINTING APPARATUS AND METHOD

BACKGROUND OF INVENTION

1. Field of the Invention

The invention relates to a printing apparatus, and more particularly, to a printing apparatus combining multi-drop and multi-pass printing processes, using quotient distribution and remainder allocation to implement multi-level printing.

2. Description of Prior Art

Please refer to FIG. 1 of a schematic diagram of a constituting structure of a prior art printing apparatus 10. The printing apparatus 10 has a controller 150, a paper-conveying device 140 and an ink jet print head 100 capable of moving along a track 170. The ink jet print head 100 has a plurality of nozzles 110 (only four nozzles 110 are shown in FIG. 1). The printing apparatus 10 is used to print words or images on a document 20. The document 20 has a printing area 30 that is divided into many jetting positions 50. Each square in the printing area 30 of FIG. 1 is a jetting position. During a printing process, the controller 150 controls the ink jet print head 100 to move along track 170 and controls the paper-conveying device 140 to move the document 20 forward (perpendicular to the track 170 in FIG. 1) so that the inkjet print head 100 covers all jetting positions 50 of the printing area 30. In the process of covering the printing area 30 by the ink jet print head 100, each nozzle 110 of the ink jet print head 100 corresponds to a jetting position.

To achieve the effect of multi-level printing, the ink jet print head 100 prints a plurality of ink spots in the same jetting position 50. Printing different amounts of ink spots on the same jetting position can achieve color levels of different concentrations and demonstrate the effect of multi-level printing to show rich levels of printing.

In a prior art printing apparatus using multi-drop printing to implement multi-level printing, an ink jet print head skims the jetting position once and prints a plurality of ink spots on the jetting position. In this prior art, a maximum number of ink spots a printing apparatus can print on the same jetting position determine the number of color levels the printing apparatus can print. If the printing apparatus can print sixteen ink spots on a jetting position, the printing apparatus can print seventeen color levels from 0 to 16.

Another prior art printer of U.S. Pat. No. 5,923,349 uses software to control the ink jet print head to implement multi-level printing by a multi-pass printing process. The ink jet print head of the printer prints only one ink spot on each jetting position, but the ink jet print head skims a jetting position once in each printing pass. Accumulation of ink spots in each printing pass on the same jetting position has an effect of multi-level printing. In this prior art, if the printer can perform four printing passes on the same jetting position, the printer can demonstrate five color levels of 0 to 4. To decide which printing passes to print the predetermined ink spots in a jetting position, the prior art printer uses a series of print masks. The prior art printer uses a print mask to determine which jetting position is to be printed with ink spots in each printing pass. If the prior art printer wants to print seventeen color levels of 0 to 16, the prior art printer prints sixteen times. A lot of time is therefore wasted in doing this. Also each printing pass needs a corresponding print mask and storing these print masks uses a lot of memory. The prior art printer has to determine which jetting position to print ink spots according to the corresponding print mask in each printing pass. Printing speed and efficiency are thus reduced.

SUMMARY OF INVENTION

It is therefore a primary objective of the present invention to provide a printing apparatus to solve the mentioned problem.

According to the claimed invention, the printing apparatus uses an ink jet print head to perform printing passes on a printing area. The ink jet print head has a plurality of nozzles that are capable of forming an ink spot on an ink jetting position on the printing area during a printing pass according to a predetermined printing method. The predetermined printing method distributes a total number of ink spots on the ink jetting position across a plurality of printing passes according to a quotient and a remainder so that a spot count on the ink jetting position is almost equal for each printing pass.

It is an advantage of the present invention that the printing apparatus according to the present invention combines a multi-drop/multi-pass printing process, and a concept of quotient distribution and remainder allocation to implement multi-level printing to replace print masks so that print time is greatly reduced and only one print mask is needed, therefore reducing memory usage.

These and other objects and the advantages of the present invention will no doubt become obvious to those of ordinary skill in the art after having read the following detailed description of the preferred embodiment that is illustrated in the various figures and drawings.

DETAILED DESCRIPTION

Figure 1:
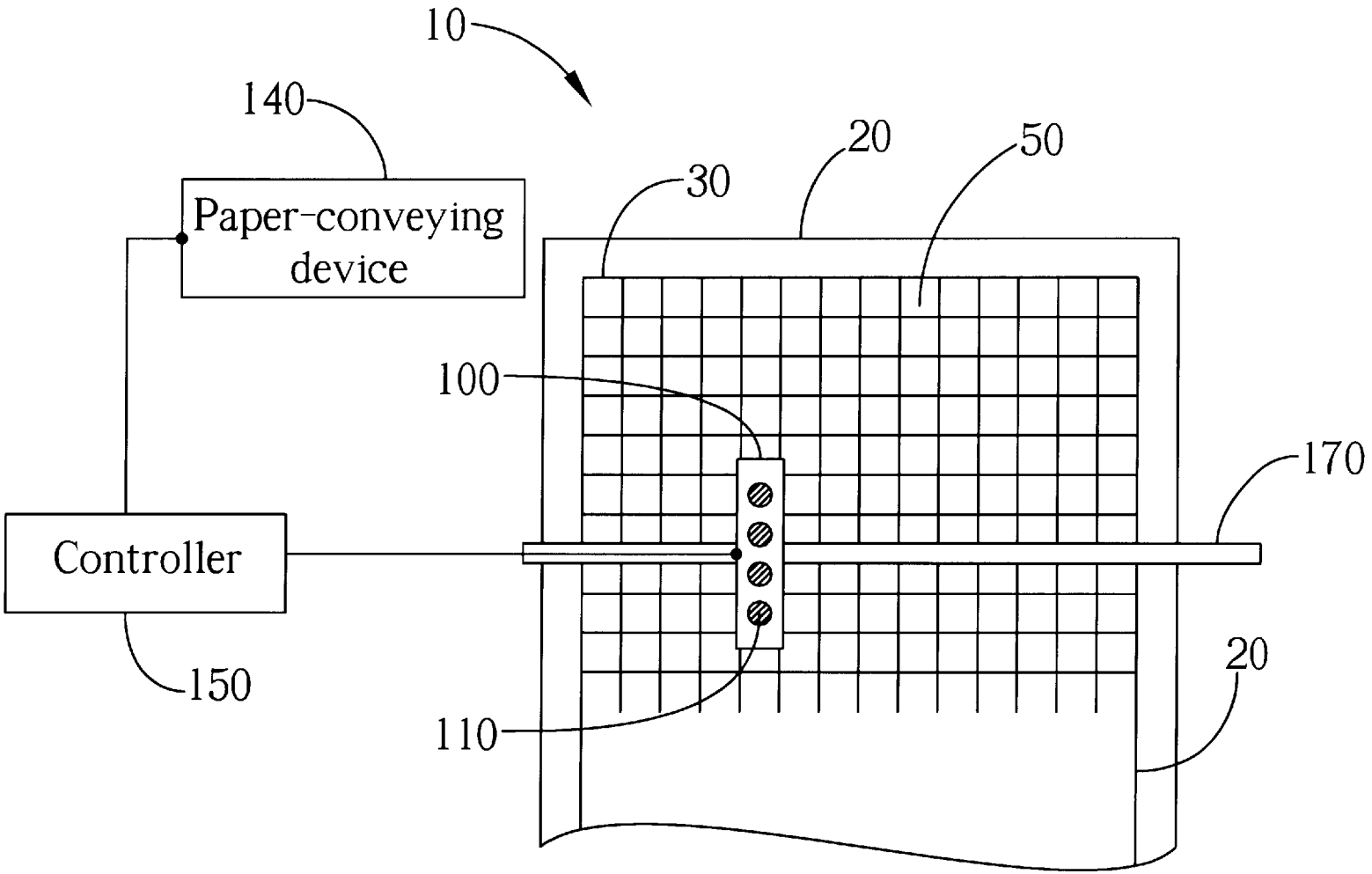
Fig. 1 Prior art
FIG. 1 is a schematic diagram of a prior art printing apparatus structure.
Figure 2B:
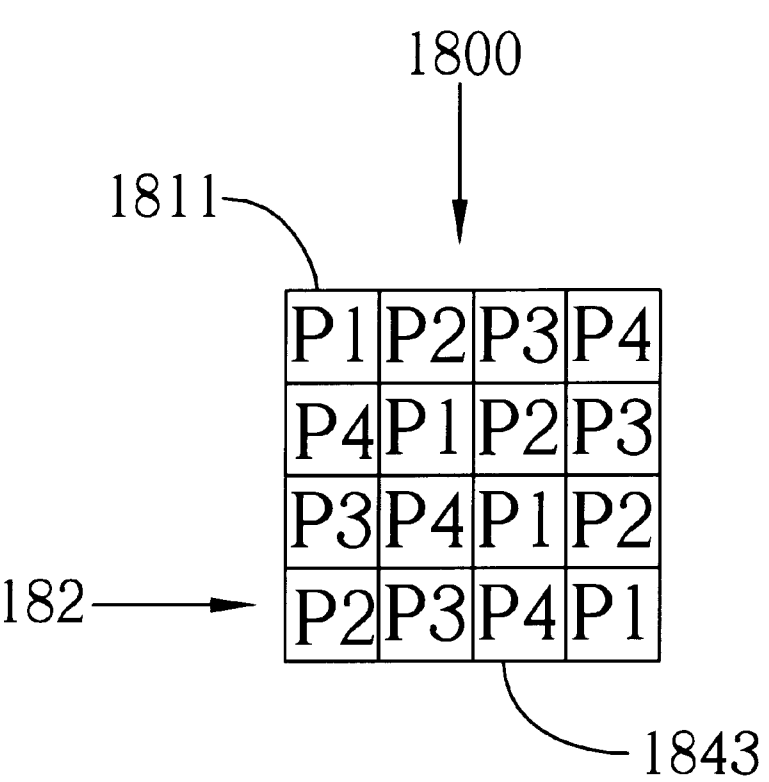
FIG. 2B is a remainder distribution table of one embodiment of the printing method of the printing apparatus of the present invention.
Figure 2A:
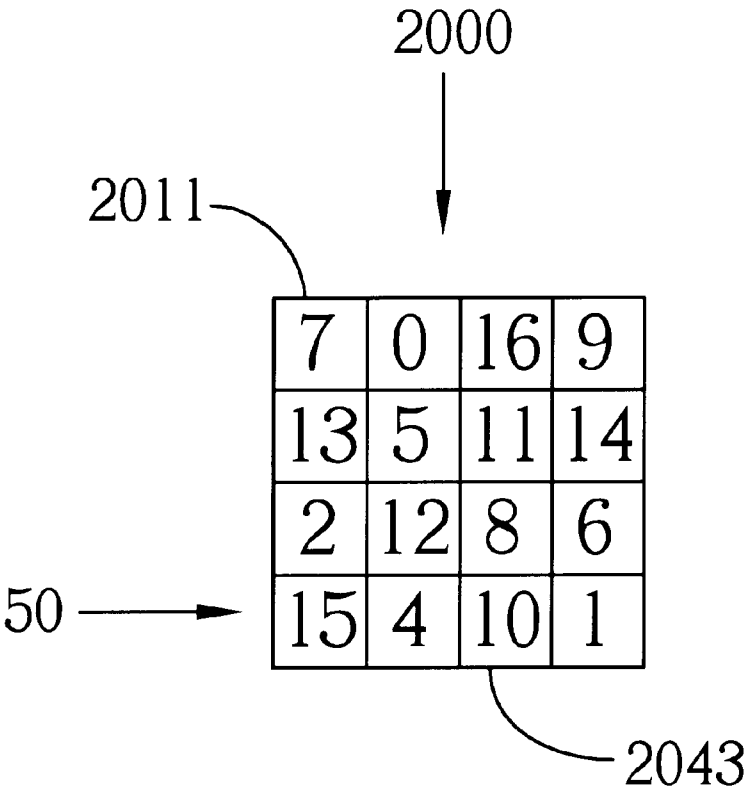
FIG. 2A is a schematic diagram of a number of ink spots on reserved jetting positions of a printing apparatus according to the present invention.
Figure 2D:
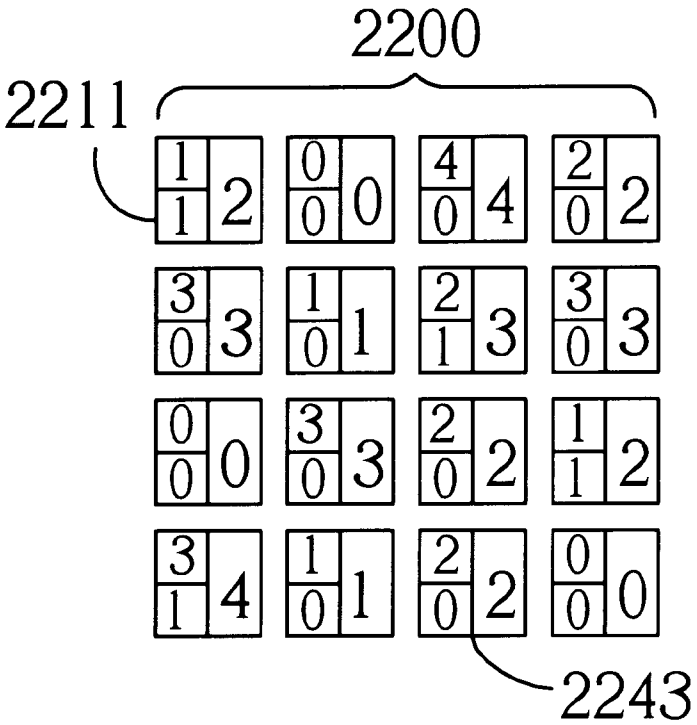
FIG. 2D is a distribution result of ink spot numbers in a second printing pass of one embodiment of the printing method of the printing apparatus of the present invention.
Figure 2C:
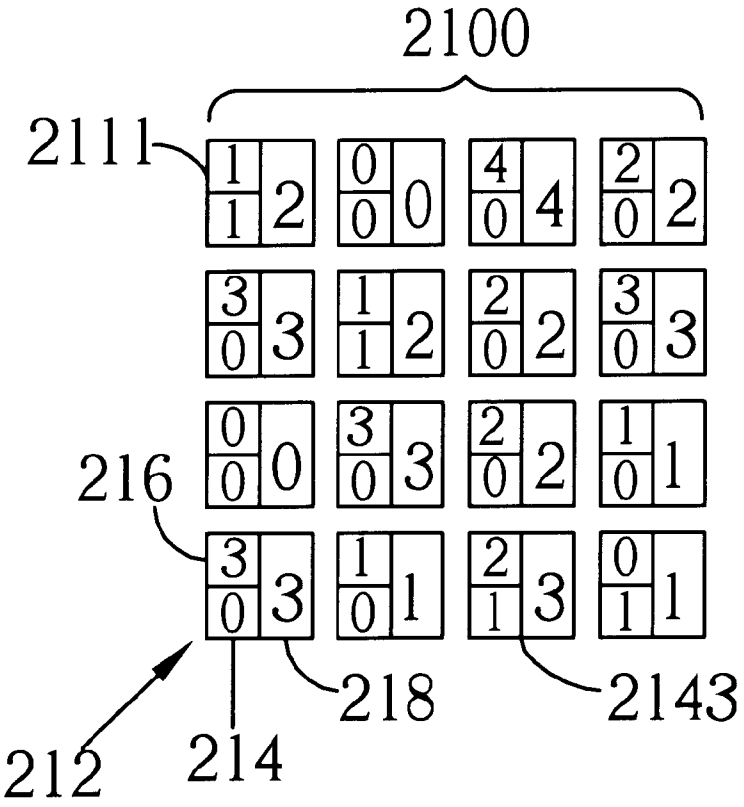
FIG. 2C is a distribution result of ink spot numbers in a first printing pass of one embodiment of the printing method of the printing apparatus of the present invention.
Figure 2F:
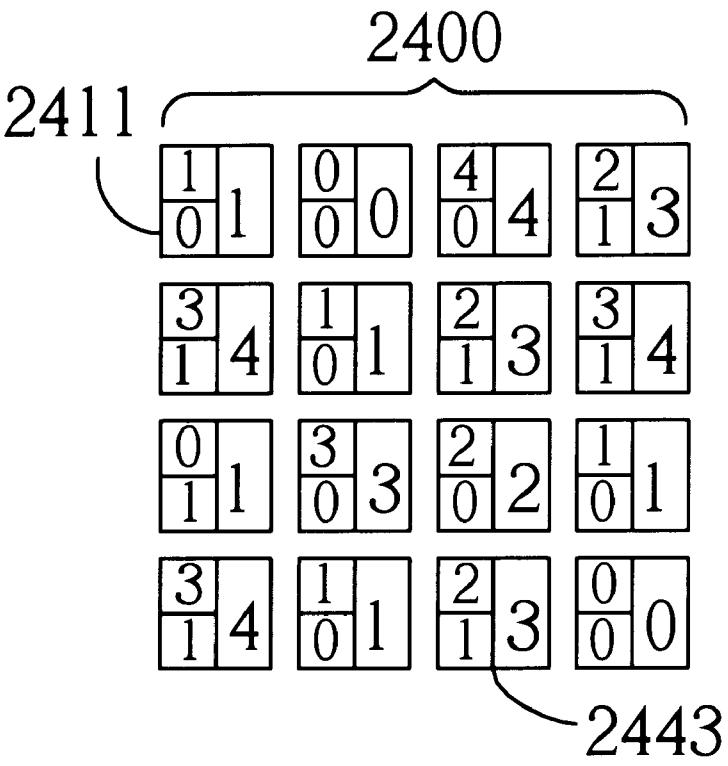
FIG. 2F is a distribution result of ink spot numbers in a fourth printing pass of one embodiment of the printing method of the printing apparatus of the present invention.
Figure 2E:
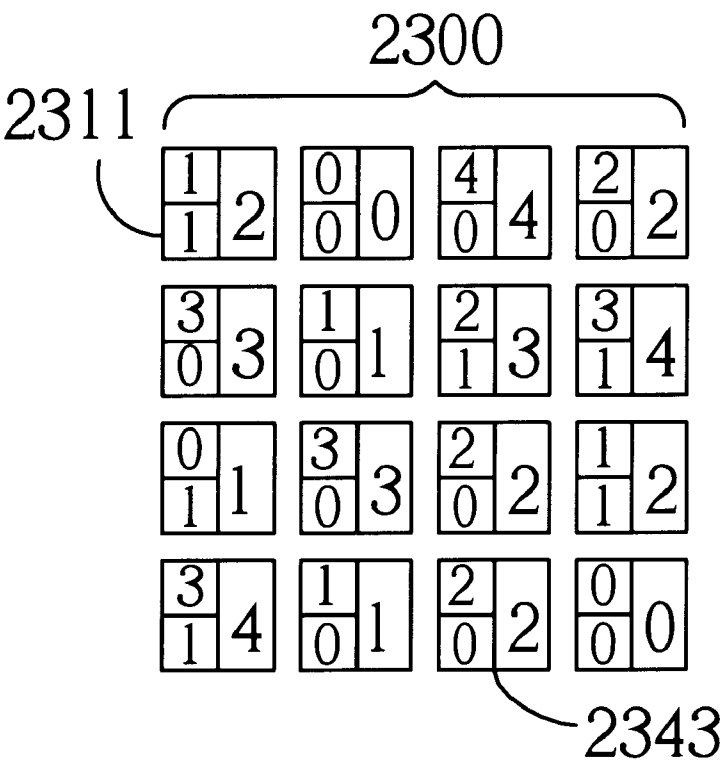
FIG. 2E is a distribution result of ink spot numbers in a third printing pass of one embodiment of the printing method of the printing apparatus of the present invention.

Please refer to FIG. 2A of a schematic diagram of a number of ink spots on reserved jetting positions of a printing apparatus 10 according to the present invention. In this example, the printing apparatus 10 of the present invention can print at most four ink spots on the same jetting position in each printing pass and can perform four printing passes on the same jetting position. So on each jetting position, the printing apparatus 10 of the present invention can print 17 color levels of 0 to 16 (the product of most ink spots in each printing pass 4 times the most printing passes 4). The 4*4 table in FIG. 2A represents a printing area 2000 consisting of 4*4 jetting positions 50. Each jetting position 50 in the printing area 2000 is represented by a square, a number in a square represents a number of ink spots to be printed on each square. As described above, the maximum number of ink spots that can be printed on each jetting position 50 is 16 in the present invention, so one jetting position can print 0 to 16 ink spots. Please refer to FIG. 2B. The printing method of the printing apparatus 10 of the present invention has a remainder distribution table 1800 for each jetting position 50 in the printing area 2000. The remainder distribution table 1800 in FIG. 2B matches each jetting position 50 in the printing area 2000 and is a 4*4 contrastive table where each square 182 determines to which printing pass the remainder ink spots of corresponding jetting position 50 are distributed. For example, if the square 182 indicates P2, a first remainder ink spot is distributed to the second printing pass, the next remainder ink spot is distributed to the next printing pass (the third printing pass). The rest may be deduced by analogy, until all remainder ink spots are distributed.

Respective distribution results 2100, 2200, 2300 and 2400 are shown, in FIG. 2C, FIG. 2D, FIG. 2E and FIG. 2F represent the results of distribution of total ink spots for each jetting position 50 in the printing area 2000 to the first; the second, the third and the fourth printing passes according to the printing method of the printing apparatus 10 of the present invention. Each distribution result respectively shown in FIG. 2C, FIG. 2D, FIG. 2E and FIG. 2F has a 4*4 big square, each big square 212 has an upper-left small square 216, a lower-left small square 214 and a right small square 218. Each square 212 corresponds to a jetting position 50, the numbers in squares 216 mean the result of the quotient of total ink spots distributed to each printing pass, the numbers in squares 214 mean the result of the remainder ink spots distributed to each corresponding jetting position according to remainder distribution table 1800. Combining the numbers of square 216 and square 214 generates a result in square 218. The result is the total ink spot number in the printing pass.

For example, the number of ink spots to be printed on a jetting position labeled as 2011 in the printing area 2000 is 7. If four printing passes are performed on the same jetting position, then total ink spot number 7 is divided by 4 to generate a quotient of 1, each printing pass is distributed with 1 ink spot (shown at upper-left small squares 216 of squares 2111, 2211, 2311 and 2411 of FIGS. 2C, D, E and F). After the quotient is distributed, the 3 remainder ink spots (the remainder of 7 divided by 4) are distributed according to square 1811 of the remainder distribution table 1800 in FIG. 2B. The 3 remaining ink spots are distributed from the first printing pass according to P1 noted in square 1811 of the remainder distribution table 1800, each printing pass is distributed one ink spot until the last remainder ink spot is distributed in the third printing pass, corresponding to the first to the fourth printing pass in lower-left small square 214 of squares 2111, 2211, 2311 and 2411. Adding up the numbers in two left small squares (214 and 216) of squares 2111, 2211, 2311 and 2411 to generate a number in right small square 218, gives the ink spot number to be printed in each pass. From this distribution result, of 7 ink spots to be printed on the jetting position 2011 (please refer to 2011 of FIG. 2A), 2 ink spots are printed in the first printing pass (please refer to 2111 of FIG. 2C), 2 ink spots are printed in the second printing pass (please refer to 2211 of FIG. 2D), 2 ink spots are printed in the third printing pass (please refer to 2311 of FIG. 2E) and 1 ink spot is printed in the fourth printing pass (please refer to 2411 of FIG. 2F).

For the same reason, the above method determines how to distribute total ink spots to be printed on other jetting positions in the print area 2000 to each printing pass. As the number of total ink spots to be printed on jetting position 2043 in the print area 2000 is 10, the number is distributed to each printing pass by division of 10 (the number of total ink spots) by 4 (the printing pass number) to generate a quotient of 2. So each printing pass prints 2 ink spots as shown in upper-left small square 216 of squares 2143, 2243, 2343 and 2443 of FIGS. 2C, D, E and F. The remainder 2 of the division 10 divided by 4, gives the remaining 2 ink spots after distribution, the first ink spot of which is distributed to the fourth printing pass and the second ink spot is distributed to the first printing pass according to square 1843 in the remainder distribution table 1800 in FIG. 2B. The final distribution is shown in right square 218 of squares 2143, 2243, 2343 and 2443 of FIGS. 2C, D, E and F, with 10 ink spots to be printed on jetting position 2043 (please refer to 2043 of FIG. 2A), of which 3 ink spots are printed in the first printing pass (please refer to 2143 of FIG. 2C), of which 2 ink spots are printed in the second printing pass (please refer to 2243 of FIG. 2D), of which 2 ink spots are printed in the third printing pass (please refer to 2343 of FIG. 2E) and of which 3 ink spots are printed in the fourth printing pass (please refer to 2443 of FIG. 2F).

Please notice that frequencies of P1, P2, P3 and P4 are equal in the remainder distribution table 1800 to make the probability of jetting the first ink spot in each printing pass equal. As described before, P1 means to print the first remainder ink spot in the first printing pass, P2 means to print the first remainder ink spot in the second printing pass, P3 means to print the first remainder ink spot in the third printing pass and P4 means to print the first remainder ink spot in the fourth printing pass. This arrangement makes homogeneity between each printing pass and less difference between distributed ink spot numbers of each printing pass.

The remainder distribution table of the present invention not only can determine the printing pass to be distributed with remainder ink spots, but also can determine the printing pass not to be distributed with remainder ink spots. This table can be adapted for different situations.

Figure 3A:
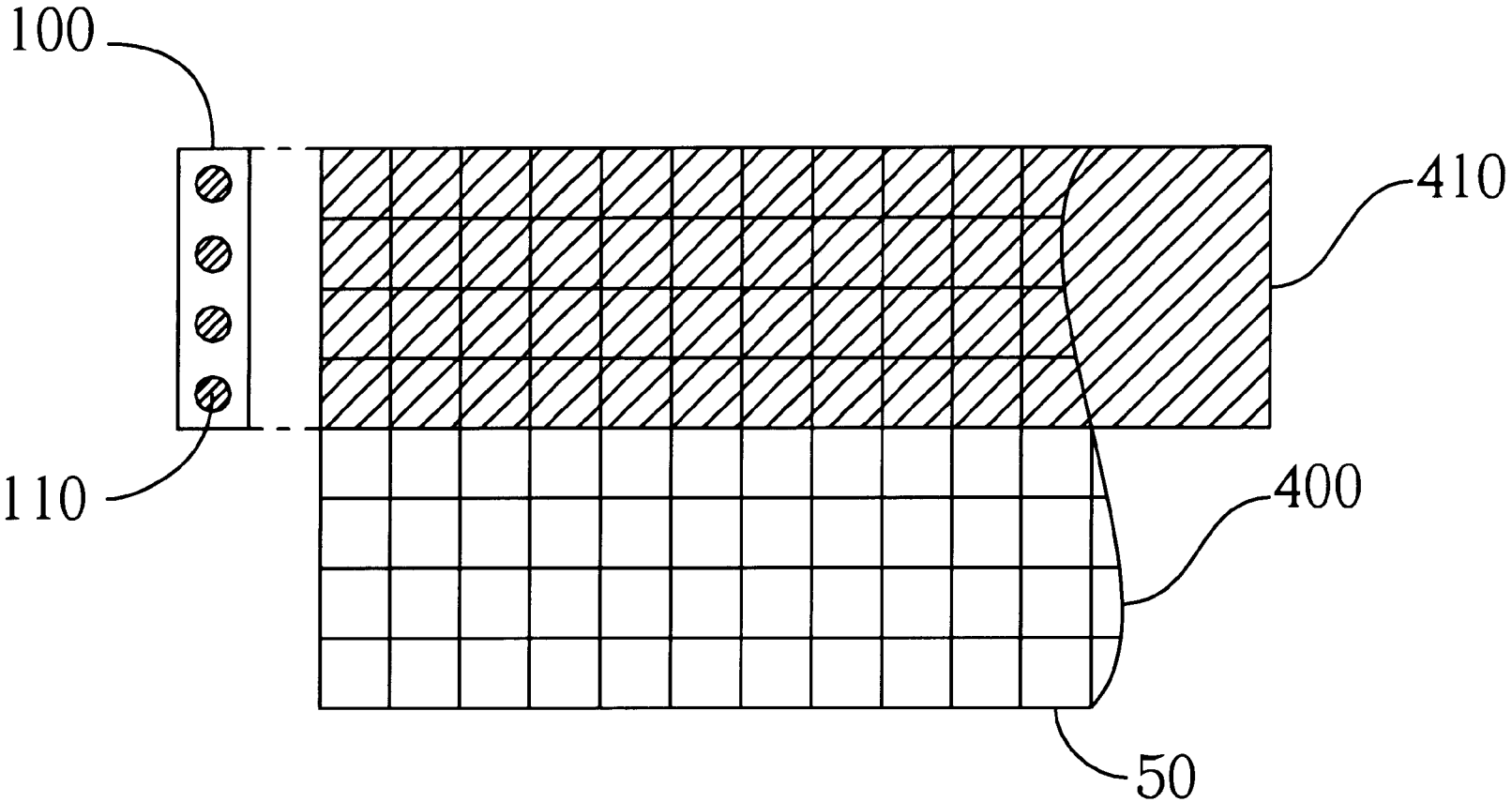
FIG. 3A is a schematic diagram of a first embodiment of the printing apparatus of the present invention implementing the first printing pass in multiple printing passes.
Figure 3B:
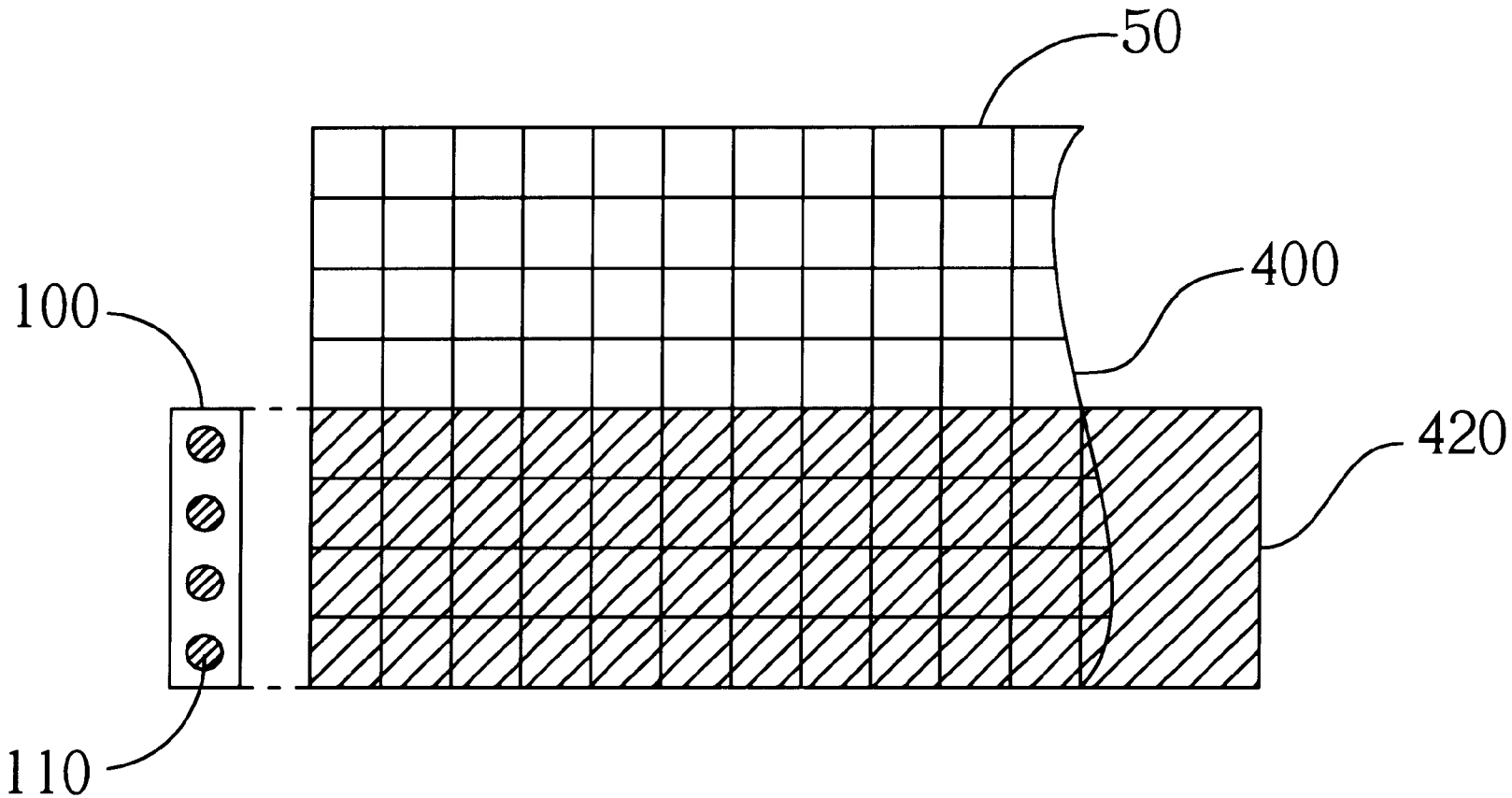
FIG. 3B is a schematic diagram of the first embodiment of the printing apparatus of the present invention implementing the second printing pass in multiple printing passes.

To explain how the present invention performs multi-pass printing, please refer to FIG. 3A. FIG. 3A is a schematic diagram of the first embodiment in the first printing pass while the printing apparatus 10 of the present invention is performing multi-pass printing. As mentioned before, the printing apparatus 10 of the present invention can perform a plurality of printing passes on the same jetting position. FIGS. 3A and B show the first embodiment of the execution of the plurality of printing passes. In FIG. 3A, an ink jet print head 100 has four nozzles 110, each nozzle 110 corresponds to a jetting position 50 in a printing area 400 and the ink jet print head 100 can move laterally to print; printing areas 410, 420 respectively defined by oblique lines in FIGS. 3A, 3B represent where ink jet print head 100 prints. For convenience, the printing apparatus also performs four printing passes on the same jetting position as the above example. Please refer to FIG. 3A. In this embodiment, the ink jet print head 100 first performs the first printing and moves back and forth in the printing area 410 until all jetting positions in the printing area 410 are printed four times, that is, a plurality of printing passes is performed on all jetting positions in the printing area 410. Please refer to FIG. 3B, in the second printing. A controller 150 controls the paper-conveying apparatus 140 to move the document forward, with the printing area 420 next to the printing area 410 moved to be printed. Similarly, in the second printing process, the ink jet print head 100 moves back and forth over the printing area 420 to perform all printing passes on all jetting positions of printing area 420. All the printing can be done in the same way.

Figure 4A:
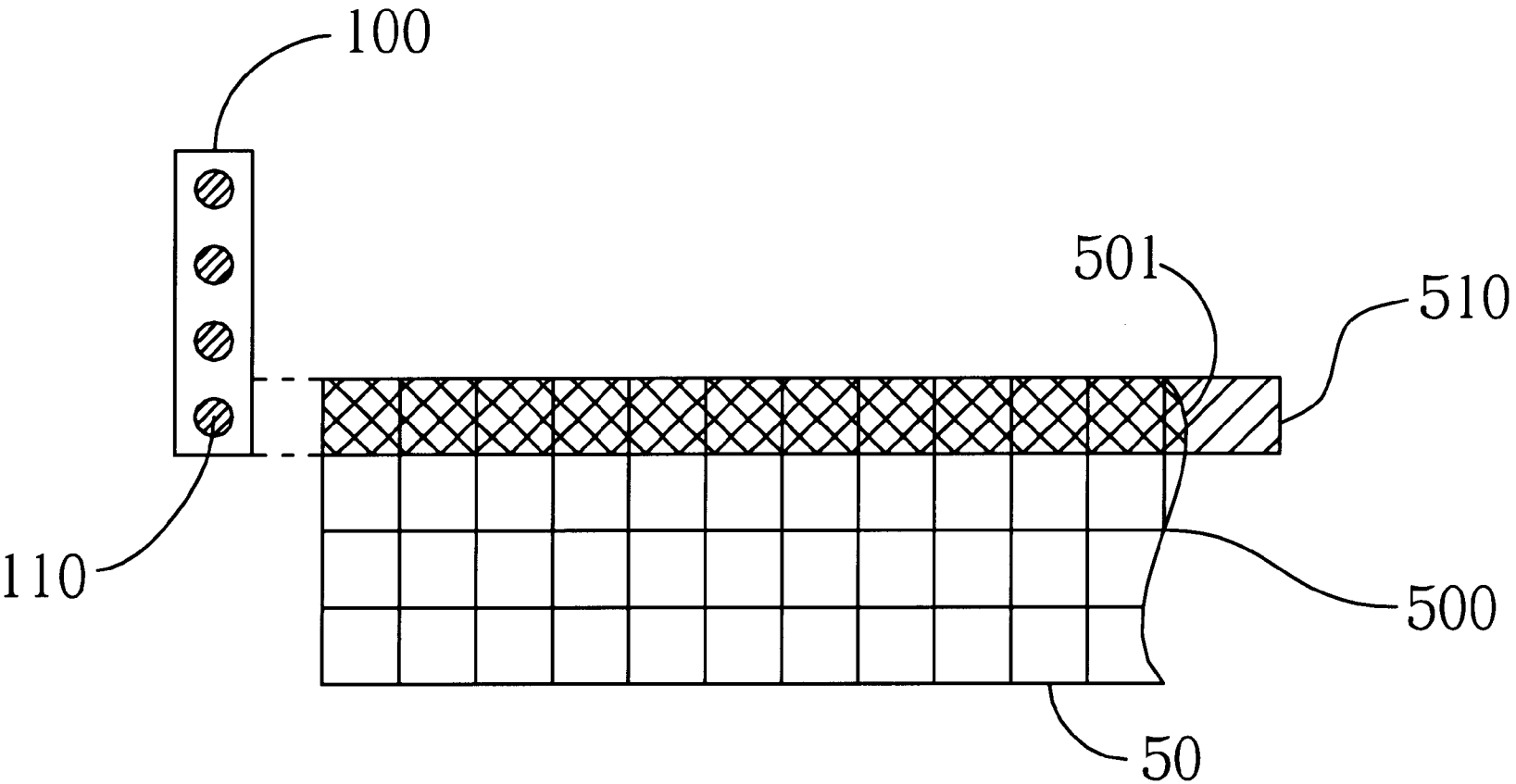
FIG. 4A is a schematic diagram of a second embodiment of the printing apparatus of the present invention implementing the first printing pass in multiple printing passes.
Figure 4B:
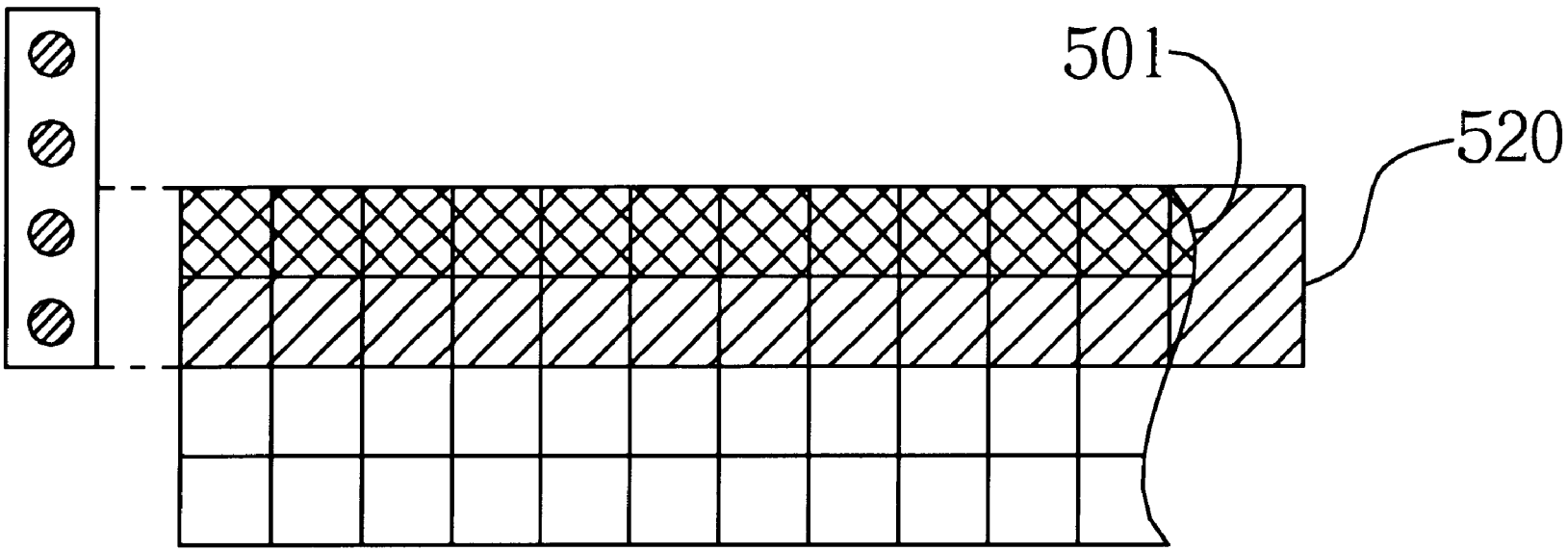
FIG. 4B is a schematic diagram of the second embodiment of the printing apparatus for the present invention implementing the second printing pass in multiple printing passes.
Figure 4C:
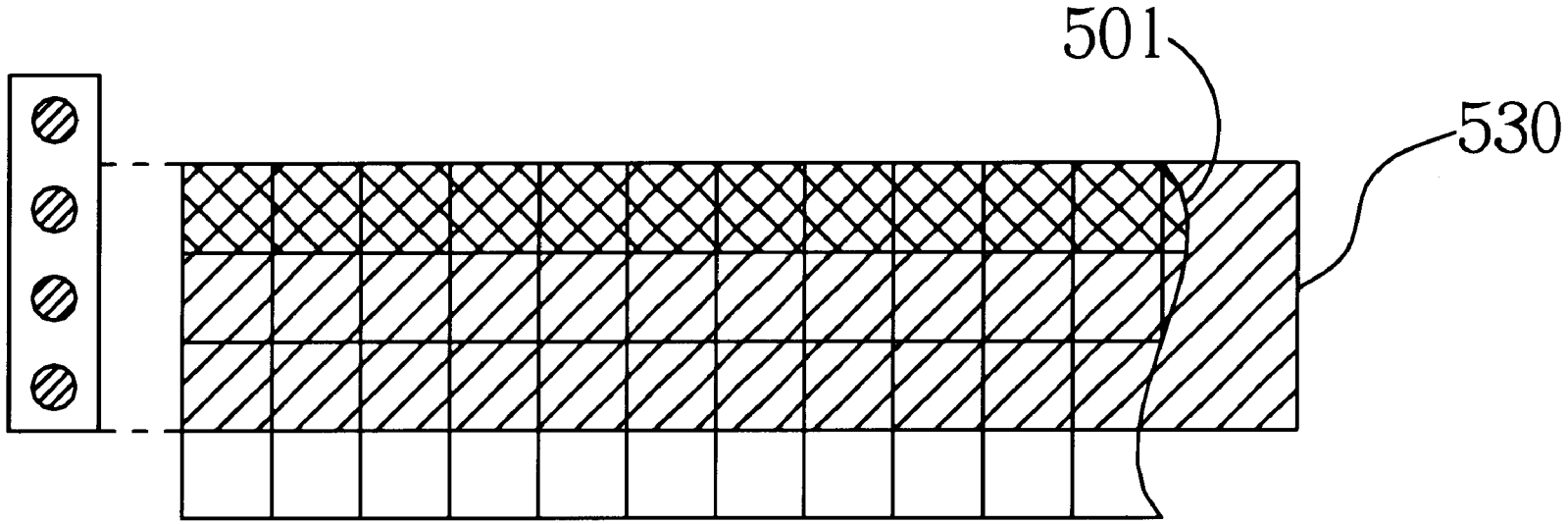
FIG. 4C is a schematic diagram of the second embodiment of the printing apparatus of the present invention implementing the third printing pass in multiple printing passes.
Figure 4D:
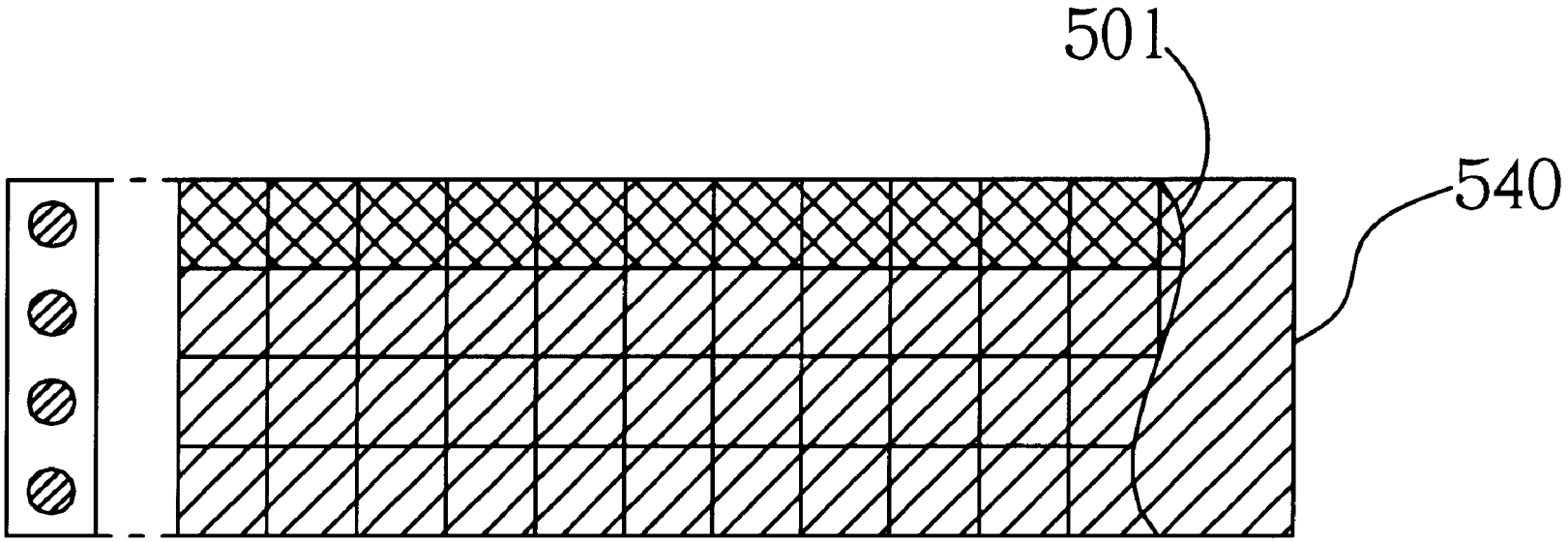
FIG. 4D is a schematic diagram of the second embodiment of the printing apparatus of the present invention implementing the fourth printing pass in multiple printing passes.

Please refer to FIG. 4A. FIG. 4A is a schematic diagram of the second embodiment in the first printing pass while printing apparatus 10 of the present invention is performing multi-pass printing. As shown in FIGS. 4A and 4B, ink jet print head 100 has four nozzles 110, a printing area 500 has a plurality of jetting positions 50; the printing apparatus 10 of the present invention is set to perform four printing passes on each jetting position, print four ink spots on each jetting position in each printing pass. Respective oblique-lined areas 510, 520, 530 and 540 in FIG. 4A define printing areas in each printing process. Please refer to FIG. 4A. The ink jet print head 100 performs one printing pass on all jetting positions 50 (jetting position line 501 in FIG. 4A) of the printing area 510 when the ink jet print head 100 is performing the first printing process of the present embodiment. Please refer to FIG. 4B. In the following second printing process, the paper-conveying device 140 drives the document up by a height of a jetting position (equivalent to a ¼ height of a swath), and then the ink jet print head 100 performs a printing pass on the printing area 520. Notice that jetting positions in the jetting position line 501 experience two printing passes because the printing area 520 covers the jetting position line 501. In the following third (please refer to FIG. 4C) and fourth printing processes (please refer to FIG. 4D), the ink jet print head 100 respectively performs a printing pass on the printing areas 530 and 540. Similarly, the printing areas 530 and 540 include the jetting position line 501, one printing pass is respectively performed on all jetting positions in the jetting position line 501 in the third and the fourth printing processes. Four predetermined printing passes are performed on all jetting positions of the jetting position line 501 from the first to the fourth printing processes. In the following printing process, the document is further driven a height of one jetting position, all jetting positions in the jetting position line 501 are no longer covered by ink jet print head and are not printed. In other words, four printing passes performed on the jetting position line 501 are performed in four printing processes.

In summation, the printing apparatus of the present invention combines multi-pass and multi-drop techniques to fulfill multi-level printing. The printing apparatus of the prior art using multi-drop techniques to fulfill multi-level printing completes printing predetermined ink spots on each jetting position in a single printing pass. In contrast, the predetermined ink spots on each jetting position printed by the printing apparatus of the present invention are printed in several printing passes.

On the other hand, the printing method of a printing apparatus of the prior art utilizing multi-pass to fulfill multi-level printing uses a series of printing masks to determine which jetting position is to be printed in each printing pass. The series of printing masks need to be stored in memory, calculation of the printing method is time-consuming and thus increases the burden on software and hardware. Relatively, the printing method of the printing apparatus of the present invention first distributes ink spots for each jetting position to each printing pass and increases uniformity of the ink jet print head between each print pass, remaining ink spots are distributed according to remainder distribution table 1800. As in FIG. 4, the second embodiment of the printing method of the present invention shows that the remainder distribution table 1800 can also make the probability of ejecting the first remainder ink spot in each printing pass equal. The printing method of the printing apparatus of the present invention increases uniformity of ink jet print head in each printing passes and also reduces requirements of software and hardware than the prior art. The distribution of the printing method of the printing apparatus of the present invention is achieved by shift operator to reduce calculation time. No matter how many printing passes predetermined by the printing method of the printing apparatus of the present invention are performed on the same jetting position, the printing method of the printing apparatus of the present invention only stores the remainder distribution table 1800, not a series of printing masks related to the number of printing passes in the prior art. Facts above show that the printing apparatus of the present invention is an improvement on the printing apparatus of the prior art.

Those skilled in the art will readily observe that numerous modifications and alterations of the propeller may be made while retaining the teachings of the invention. Accordingly, the above disclosure should be construed as limited only by the metes and bounds of appended claims.

What is claimed is:

1. A printing apparatus for printing on a printing area of a document, the printing apparatus comprising:

an ink jet print head that performs a plurality of printing passes on the printing area, the inkjet print head having a plurality of nozzles and each nozzle capable of forming at least an ink spot on an ink jetting position of the printing area during a printing pass;

wherein the ink jet print head performs the printing according to a predetermined printing method, the predetermined printing method distributing a total number of ink spots on the ink jetting position across the plurality of printing passes according to a quotient and a remainder so that a spot count on the ink jetting position is approximately equal for each printing pass.

2. The printing apparatus of claim 1 wherein remainder ink spots are distributed to at least one of the plurality of printing passes according to a remainder distribution table, the remainder inks spots being ink spots that cannot be evenly distributed across the plurality of printing passes after a portion of the total number of ink spots are evenly distributed across the plurality of printing passes.

3. The printing apparatus of claim 2 wherein the remainder distribution table indicates a printing pass to which a first remainder ink spot is distributed, and to which a next remainder ink spot is distributed to a next printing pass in order until all the remainder ink spots are distributed.

4. The printing apparatus of claim 3 wherein the remainder distribution table ensures that a probability of jetting the first remainder ink spot in the plurality of printing passes is approximately equal.

5. The printing apparatus of claim 1 wherein the document moves so that the ink jet print head is able to print a next printing area after the ink jet print head completes the plurality of printing passes on the printing area.

6. The printing apparatus of claim 1 wherein the document moves so that the ink jet print head is able to perform a next printing pass after the ink jet print head completes a printing pass on the printing area.

7. A printing method for printing on a printing area of a document, the method comprising:

using an ink jet print head to form a plurality of printing passes on the printing area, a plurality of ink spots being jetted on an ink jetting position of the printing area in each pass; and performing the printing pass according to a predetermined method, the predetermined method including distributing a total number of ink jet spots on the printing area across the plurality of printing passes according to a quotient and a remainder so that a spot count on the ink jetting position is approximately equal in each printing pass.

8. The printing method of claim 7 wherein the method distributes remainder ink spots to at least one of the plurality of printing passes according to a remainder distribution table, the remainder inks spots being ink spots that cannot be evenly distributed across the plurality of printing passes after a portion of the total number of ink spots are evenly distributed across the plurality of printing passes according to the quotient.

9. The printing method of claim 8 wherein the remainder distribution table indicates a printing pass to which a first remainder ink spot is distributed, and a next remainder ink spot is distributed to a next printing pass until all the remainder ink spots are distributed.

10. The printing method of claim 9 wherein the remainder distribution table ensures that a probability of jetting the first remainder ink spot is approximately equal for each printing pass.

11. The printing method of claim 7 wherein the document is moved so that the ink jet print head is able to perform a next printing pass on a next printing area after the finishing the plurality of printing passes on the printing area.

12. The printing method of claim 7 wherein the document is moved for a next printing pass after a printing pass on the printing area is finished.

13. A printing method for printing on a printing area, the method comprising:

using an ink jet print head to execute a plurality of printing passes on the printing area, a plurality of ink spots being jetted on an ink jetting position of the printing area in each pass; and performing the printing passes according to a predetermined method that comprises:

evenly distributing a total number of ink spots on the printing area across the plurality of printing passes according to a quotient and a remainder so that a number of ink spots jetted on the ink jetting position is approximately equal in each printing pass; and distributing remainder ink spots to at least one of the plurality of printing passes according to a remainder distribution table, the remainder ink spots being ink spots that cannot be distributed after the total number of ink spots are evenly distributed to the plurality of printing passes according to the quotient.

14. The printing method of claim 13 wherein the remainder distribution table indicates a printing pass to which a first remainder ink spot is distributed, and a next printing pass to which a second remainder ink spot is distributed until all the remainder ink spots are distributed.

15. The printing method of claim 13 wherein the remainder distribution table ensures that a probability of jetting a first remainder ink spot is approximately equal in each printing pass in the plurality of printing passes.

16. A printing method for a printing apparatus, the printing apparatus having a print head, wherein the print head can performs a plurality of printing passes, the method comprising:

providing a printing area, the printing area having a plurality of jetting positions, wherein each jetting position is set a total ink spot number, a largest total ink spot number is larger than or equal to 1;

setting a largest ink spot number for the print head printing on each jetting position in one printing pass, wherein the largest ink spot number is larger than or equal to 1;

setting a printing pass number needed for the printing area, wherein the printing pass number is larger than 1, and (the largest ink spot number)×(the printing pass number) is larger than or equal to the largest total ink spot number;

performing a quotient distributing step, distributing the total ink spot number evenly on the printing area across the plurality of printing passes to get a quotient and a remainder so that the quotient is distributed to each printing pass;

providing a remainder distribution table;

performing a remainder distributing step, distributing the remainder evenly to at least one of the plurality of printing passes according to the remainder distribution table; and calculating a distributing result, wherein in each printing pass, one part of the jetting positions is distributed the quotient, and another part of the jetting positions is distributed the quotient plus 1.

17. The printing method of claim 16 wherein the remainder distribution table is a square matrix of (the printing pass number)×(the printing pass number), each element inside the matrix having a value representing a first printing pass that will be distributed an ink spot when performing the remainder distributing step.

18. The printing method of claim 16 wherein the values representing a first printing pass that will be distributed an ink spot are evenly distributed for all printing passes in the remainder distribution table.

* * * * *